United States Patent [19]

David

[11] 3,982,684

[45] Sept. 28, 1976

[54] CARTON DIVIDER PAD

[75] Inventor: Frank A. David, Collinsville, Ill.

[73] Assignee: Owens-Illinois, Inc., Toledo, Ohio

[22] Filed: Apr. 28, 1975

[21] Appl. No.: 572,107

[52] U.S. Cl. ..... 229/28 R; 229/15

[51] Int. Cl.[2] ..... B65D 5/48; B65D 3/24

[58] Field of Search ..... 229/15, 27, 28 R, 28 BC, 229/42; 217/22; 206/179, 196

[56] References Cited

UNITED STATES PATENTS

| | | | |
|---|---|---|---|
| 3,048,318 | 8/1962 | Sabin | 229/15 |
| 3,064,871 | 11/1962 | Wood | 217/22 |
| 3,257,027 | 6/1966 | Weiss | 206/196 |
| 3,412,920 | 11/1968 | Desforges | 229/15 |
| 3,478,947 | 11/1969 | Schillinger | 229/28 R |

*Primary Examiner*—George E. Lowrance
*Assistant Examiner*—Douglas B. Farrow
*Attorney, Agent, or Firm*—A. J. Steger; E. J. Holler

[57] ABSTRACT

A unique one-piece, H-shaped divider pad for a carton is provided with integral projections or separator tabs which may be utilized to separate the carton into six compartments. The divider incorporates folded panels which form a standard H-shaped divider. In addition, a number of projections or separator tabs are provided which extend outwardly from the H-shaped divider into contact with the carton to divide the areas exterior of the H, thereby separating the carton into six compartments and to rigidly position the divider within the carton.

4 Claims, 3 Drawing Figures

CARTON DIVIDER PAD

BACKGROUND OF THE INVENTION

This invention relates to dividers for cartons and, more specifically, it relates to a unique one-piece, H-shaped divider which incorporates projections which are capable of separating the carton into six compartments.

Dividers of various sizes and shapes have long been used to form cells or compartments within a carton for separating and cushioning the articles being packaged in the carton. An H-shaped divider pad has become popular for use in dividing a carton into two small and two large compartments, the two small compartments being located on the interior of the H and the two large compartments being formed exterior of the H when such a divider pad is positioned within a carton. A modification of the H-shaped divider pad, sometimes referred to as a "special H", has been utilized more recently in the packaging trade. The special H incorporates folded flaps on the ends of each of the four leg panels of the H which are folded to a position 90° relative to the leg members and are utilized to position or center the H-shaped divider within a carton. However, such H-shaped or special H dividers have a drawback in that they divide the carton into only four compartments, two small cells in the middle of the carton and two large cells along the outside edges of the H.

To date, when it is desired to divide a carton into more than four individual, equal-sized compartments, it has been necessary to utilize a multi-piece criss-cross divider. Such multi-piece dividers are considerably more expensive to handle and assemble and more difficult to utilize than is a one-piece divider. Thus, there has been a long felt need in the corrugated paperboard packaging industry for a one-piece carton divider which is suitable for dividing a carton into six equal sized compartments or cells.

SUMMARY OF THE INVENTION

It is, therefore, an object of this invention to provide a one-piece divider pad for a carton which eliminates the problems associated with multi-cell dividers found in the prior art. The unique one-piece H-shaped divider of this invention incorporates integral projections or separator tabs which are adapted to separate the carton into six equal compartments or cells. The projections, as disclosed by this invention, may be incorporated with special-H positioning flaps to properly position the H-shaped divider within the carton and also add to the stacking strength of the carton.

Other objects, features and advantages of this invention will become obvious to one skilled in the art to which it pertains upon reference to the following detailed description of the invention and the drawings illustrating a preferred embodiment thereof.

DESCRIPTION OF A PREFERRED EMBODIMENT OF THE INVENTION

Figure 1:
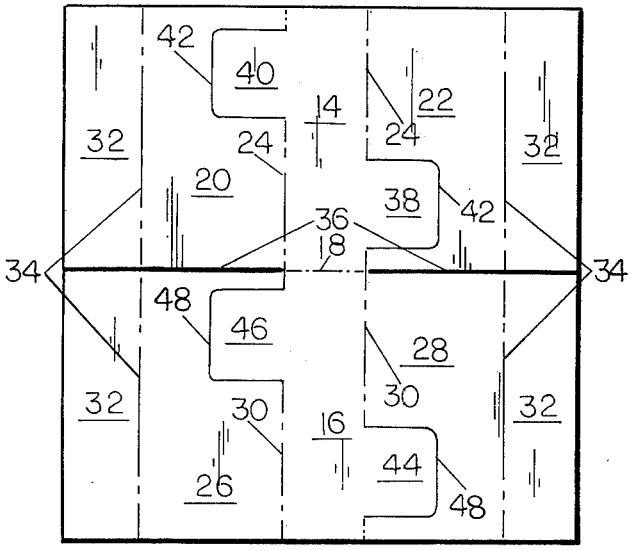
FIG. 1 is a top plan view of a corrugated paperboard blank which has been slit, slotted and scored, so as to be foldable to form the unique one-piece, H-shaped divider of this invention.

In FIG. 1 of the drawings, the numeral 10 is utilized to indicate generally a blank of corrugated paperboard material. The blank 10 is adapted to be folded into the unique H-shaped divider pad of this invention, indicated generally by the numeral 12 in FIGS. 2 and 3. Corrugated paperboard blank 10 includes a pair of center panels 14 and 16, which are hingedly attached to each other along a fold or score line 18. Center panel 14 has a pair of leg panels 20 and 22 which are hingedly attached thereto along a pair of score lines 24. Similarly, center panel 16 has a pair of leg panels 26 and 28 hingedly attached thereto along a pair of score lines 30. Each of the leg panels 22, 24, 26 and 28 has an end flap 32 hingedly attached thereto along a score line 34. As can be seen in FIG. 1, the leg panels and end flaps associated with center panel 14 and the leg panels and end flaps associated with center panel 16 are separated from each other by a pair of slots 36. The center panel 14 has a pair of projection tabs 38 and 40 formed integral therewith and separable from leg panels 22 and 20 respectively along three sides by means of slit lines 42. Similarly, center panel 16 has a pair of projection tabs 44 and 46 formed integral therewith and separable along three sides from leg panels 28 and 26 respectively by means of slit lines 48.

Figure 2:
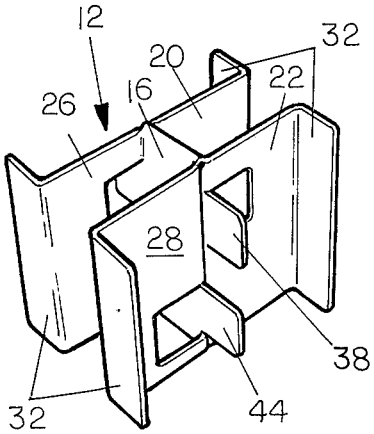
FIG. 2 is a perspective view of an assembled H-shaped divider in accordance with this invention which has been formed from the blank of FIG. 1.

When it is desired to fold the blank 10 of FIG. 1 so as to form the H-shaped divider of FIG. 2, the center panels 14 and 16 are folded about their score line 18 into overlapping, face-to-face relationship. The leg panels 20 and 22 are then folded 90° relative to the center panel 14 along the score lines 24, so as to form parallel leg members of the H. It should be noted that as leg panels 20 and 22 are folded, projecting tabs 38 and 40, which are integral with center panel 14, separate from the leg panels 20 and 22 along the slits 42, so as to remain integral with and parallel to the center panel 14. Similarly, the leg panels 26 and 28 are folded to a position 90° relative to the center panel 16, so as to form the remaining pair of leg portions of the H. As leg panels 26 and 28 are folded, the projection tabs 44 and 46 are separated therefrom along slit lines 48 and remain integral with and parallel to the center panel 16. The four end flaps 32 may then be folded 90° with respect to their corresponding leg panel to form the reinforcing corner flaps of the H divider.

Figure 3:
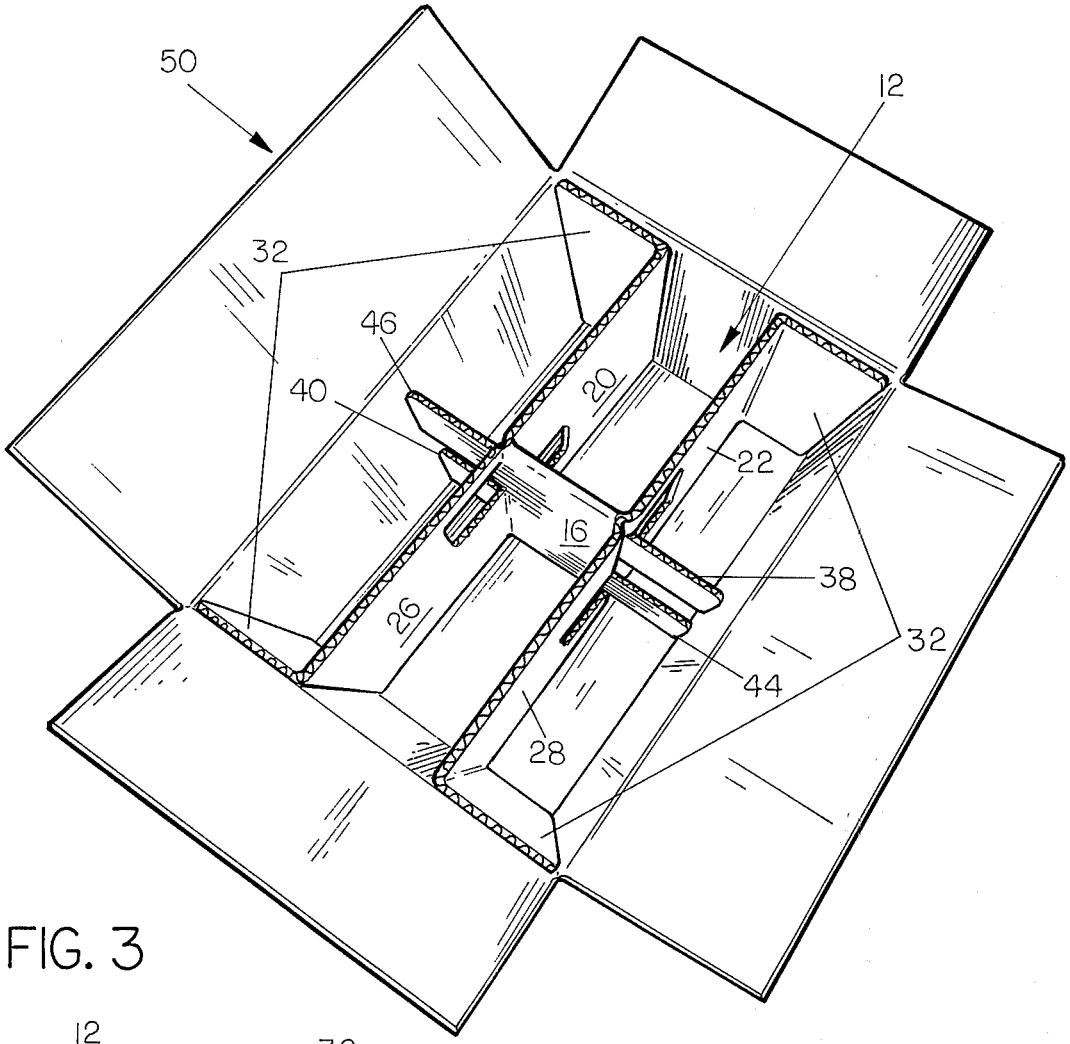
FIG. 3 is a top perspective view of the H-shaped divider of this invention inserted into a suitable carton.

The unique H-shaped divider pad 12, as shown in FIG. 2, is then adapted to be inserted into a suitable carton, such as that indicated by the numeral 50 in FIG. 3 to divide the carton into six equal compartments or cells. It can be seen in FIG. 3 that the unique separator tabs 38, 40, 44 and 46 extend into contact with the sidewalls of the carton 50 to position the divider pad 12 within the carton 50 and to divide the space exterior of the H into equal sized compartments. Without these unique separator tabs, the H-shaped divider would merely divide the carton 50 into two small compartments between the leg panels of the H and two large compartments exterior of the leg panels of the H. It can be noted also in FIG. 3 that the end flaps 32 serve as positioning and reinforcing members for the H-shaped divider when it is located within the carton 50. In addition, these end flaps 32 are of approximately the same width as the separator tabs 38, 40, 44, and 46 to combine with the separator tabs 38, 40, 44 and 46 to position the divider pad within carton 50 and to provide additional side-to-side strength and stacking strength within the carton 50.

While the unique one-piece H-shaped divider of this invention has been illustrated incorporating four separator tabs, it should be clear that two such tabs, one extending outwardly on each side of the H may be adequate to provide the compartment separation desired. For example, if the shape of the articles to be inserted within the compartments is such that separation only near the bottom is desired, the separator tabs 38 and 46 could be eliminated with only separator tabs 40 and 44 remaining. Conversely, if only separation in the upper portions of the carton is needed, then separator tabs 40 and 44 could be eliminated. Also, if it is desired to separate a carton into four equal small compartments and one large compartment, the separator tabs on one side, such as 40 and 46, may be eliminated so that that compartment remains larger than the others.

From the preceding, it should be apparent that this invention provides a unique one-piece H-shaped divider pad which is capable of dividing a carton into five or more compartments or six equal-sized compartments and eliminates the necessity of using multi-piece divider devices.

I claim:

1. A self-positioning, one-piece, H-shaped divider pad insertable into a carton to divide the carton into six equal-sized compartments, said divider pad comprising, in combination:

a first center panel;

a second center panel hingedly attached along one edge thereof to said first center panel and foldable into overlying, face-to-face relationship relative to said first center panel;

a first pair of leg panels hingedly attached to the opposite edges of said first center panel and foldable out of the material of said first center panel to a position substantially perpendicular to said first center panel;

a second pair of leg panels hingedly attached to the opposite edges of said second center panel and foldable out of the material of said second center panel to a position substantially perpendicular to said second center panel and substantially parallel to said first pair of leg panels;

a first projection tab formed integral and coextensive with said first center panel and defined by slit lines in one of said first pair of leg panels to be severable from said leg panel and extend outwardly from said leg panel in the plane of said first center panel into contact with said carton to divide the space exterior of said divider pad on one side of said divider pad within said carton and to position the divider pad within the carton when said leg panel is folded to a position substantially perpendicular to said first center panel; and a second projection tab formed integral and coextensive with said second center panel and defined by slit lines in one of said first pair of leg panels to be severable from said leg panel and extend outwardly from said leg panel in the plane of said second center panel into contact with said carton to divide the space exterior of said divider pad on the other side of said divider pad within said carton and to position the divider pad within said carton when said leg panel is folded to a position substantially perpendicular to said second center panel.

2. The self-positioning, one-piece, H-shaped divider pad of claim 1, further including an end flap of approximately the same width as said first and second projection tabs hingedly attached to the free end of each of said leg panels and foldable to a position substantially perpendicular to said leg panels to cooperate with said first and second projection tabs to position said divider pad within said carton.

3. A self-positioning, one-piece, H-shaped divider pad insertable into a carton to divide the carton into six equal-sized compartments, said divider pad comprising, in combination:

a first center panel;

a second center panel hingedly attached along one edge thereof to said first center panel and foldable into overlying, face-to-face relationship to said first center panel;

a first pair of leg panels hingedly attached to the opposite edges of said first center panel and foldable out of the material of said first center panel to a position substantially perpendicular to said first center panel;

a second pair of leg panels hingedly attached to the opposite edges of said second center panel and foldable out of the material of said second center panel to a position substantially perpendicular to said second center panel and substantially parallel to said first pair of leg panels;

a first pair of projection tabs formed integral and coextensive with the opposite edges of said first center panel and defined by slit lines in said first pair of leg panels to be severable from said first pair of leg panels, and extend outwardly from said first pair of leg panels in the plane of said first center panel into contact with said carton to divide the spaces exterior of said divider pad within said carton and to position the divider pad within said carton when said first pair of leg panels are folded to a position substantially perpendicular to said first center panel; and a second pair of projection tabs formed integral and coextensive with the opposite edges of said second center panel and defined by slit lines in said second pair of leg panels to be severable from said second pair of leg panels, and extend outwardly from said second pair of leg panels in the plane of said second center panel into contact with said carton to cooperate with said first pair of projection tabs to divide the spaces exterior of said divider pad within said carton and to position the divider pad within said carton when said second pair of leg panels are folded to a position substantially perpendicular to said second center panel.

4. The self-positioning, one-piece, H-shaped divider pad of claim 3, further including an end flap of approximately the same width as said first and second pair of projection tabs hingedly attached to the free end of each of said leg panels and foldable to a position substantially perpendicular to said leg panels to cooperate with said first and second pair of projection tabs to position said divider pad within said carton.

* * * * *